US010723430B2

(12) United States Patent
Raimondi

(10) Patent No.: US 10,723,430 B2
(45) Date of Patent: Jul. 28, 2020

(54) PROPELLER SYSTEM FOR A WATERCRAFT

(71) Applicant: VOLTA BOATS GmbH, Silvaplana (CH)

(72) Inventor: Giorgio Raimondi, Silvaplana (CH)

(73) Assignee: VOLTA BOATS GmbH, Silvaplana (CH)

( * ) Notice: Subject to any disclaimer, the term of this patent is extended or adjusted under 35 U.S.C. 154(b) by 19 days.

(21) Appl. No.: 16/087,730

(22) PCT Filed: Mar. 7, 2017

(86) PCT No.: PCT/EP2017/055330
§ 371 (c)(1),
(2) Date: Sep. 24, 2018

(87) PCT Pub. No.: WO2017/167555
PCT Pub. Date: Oct. 5, 2017

(65) Prior Publication Data

US 2019/0112019 A1 Apr. 18, 2019

(30) Foreign Application Priority Data

Mar. 31, 2016 (EP) ..... 16163241

(51) Int. Cl.

| | |
|---|---|
| ***B63H 20/16*** | (2006.01) |
| ***B63H 21/17*** | (2006.01) |
| ***B63H 1/18*** | (2006.01) |
| *B63H 20/10* | (2006.01) |
| *B63H 20/12* | (2006.01) |
| *B63H 20/22* | (2006.01) |

(52) U.S. Cl.
CPC ..... *B63H 21/17* (2013.01); *B63H 1/18* (2013.01); *B63H 20/10* (2013.01); *B63H 20/12* (2013.01); *B63H 20/22* (2013.01); *B63H 2001/185* (2013.01)

(58) Field of Classification Search
CPC .... B63H 20/22; B63H 1/18; B63H 2001/185; B63H 2023/0216; B63H 23/12
See application file for complete search history.

(56) References Cited

U.S. PATENT DOCUMENTS

2006/0057910 A1 3/2006 Stallings
2011/0263165 A1* 10/2011 Rolla ..... B63H 5/1252 440/6
2018/0079477 A1* 3/2018 Baumberger ..... B63H 20/14

FOREIGN PATENT DOCUMENTS

GB 2028746 A 3/1980

* cited by examiner

*Primary Examiner* — Andrew Polay
(74) *Attorney, Agent, or Firm* — The Webb Law Firm

(57) ABSTRACT

A propeller propulsion system for a watercraft includes at least one electric motor and a propeller which can be driven by the electric motor. The propeller is a surface piercing propeller. The propulsion system includes a box-like body having a side wall on which the electric motor is fixed and a cover part on which an outdrive of the surface piercing propeller is applied. The side wall and the cover part include holes through which a shaft of the motor and a shaft of the outdrive respectively pass. The box-like body includes means for transmission of motion from the drive shaft to the outdrive shaft, and the propulsion system includes means for fixing the box-like body to a transom of the watercraft.

7 Claims, 8 Drawing Sheets

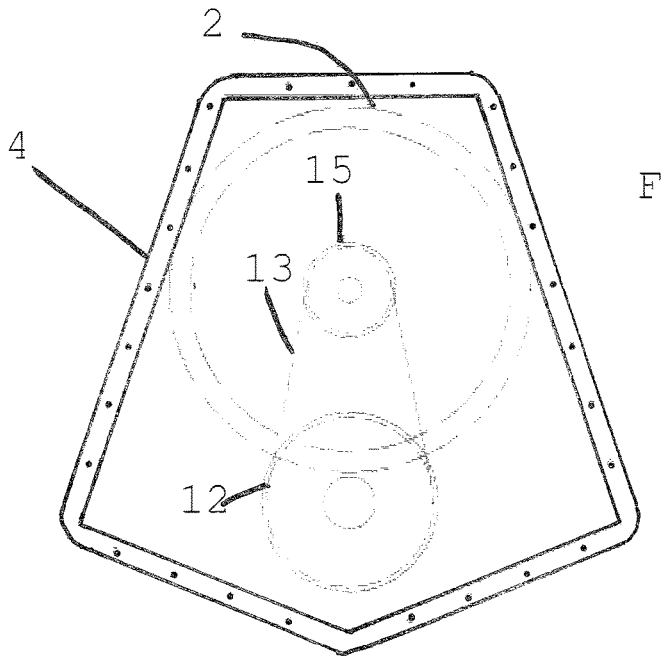
Fig. 3
Fig. 4a
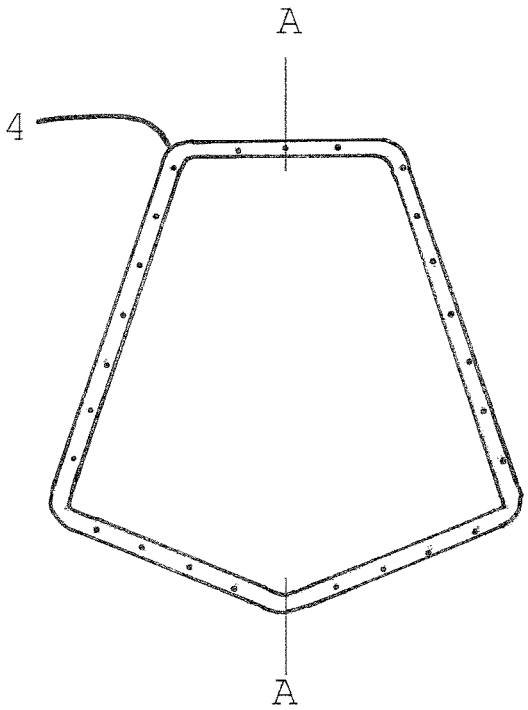
Fig. 4b
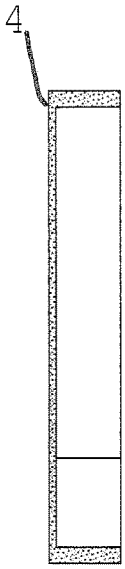

PROPELLER SYSTEM FOR A WATERCRAFT

CROSS-REFERENCE TO RELATED APPLICATIONS

This application is the United States national phase of International Application No. PCT/EP2017/055330 filed Mar. 7, 2017, and claims priority to European Patent Application No. 16163241.9 filed Mar. 31, 2016, the disclosures of which are hereby incorporated in their entirety by reference.

FIELD OF APPLICATION

The present invention relates to a propeller propulsion system for a watercraft, comprising at least one electric motor and a propeller which can be driven by the electric motor.

The invention relates also to a method for applying the abovementioned propulsion system to a watercraft.

PRIOR ART

Propeller systems for watercraft, equipped with an electric motor, are known.

Such systems are formed by an outboard electric motor, intended to drive the propeller by means of a transmission mechanism which extends along a vertical shank. In use, the propeller is immersed in water, at one end of the shank, a few decimetres beneath the water surface in the case of watercraft of small and medium dimensions.

These systems are particularly appreciated since they are very silent such that they are preferred for travel through conservation areas or for patrols.

However, the known electric motor propulsion systems are suitable only for covering limited distances, since the battery life is rather limited and it runs out quickly, due to the high level of resistance encountered by the propeller under water. For similar reasons, such systems are unable to reach high speeds. Furthermore, although they are very silent and ecologically more sustainable than combustion engines, they produce pollution, for example due to the lubricants used to ensure correct and long-lasting operation of the moving parts, in particular the gears which ensure transmission of the movement of the drive shaft to the propeller.

GB 2 028 746 is an example of a known propeller propulsion system.

The problem underlying the present invention is that of reducing or eliminating the drawbacks which at present affect electric motors for watercraft, and in particular devising a propulsion system which is capable, for the same electric battery and watercraft, of achieving higher speeds, increasing the battery life and therefore the distances which can be covered, but also reducing the environmental impact, and for this latter aim also allowing simple adaptation of watercraft at present equipped with combustion-based propulsion systems, namely suitable for easily and rapidly replacing such combustion-based propulsion systems.

SUMMARY OF THE INVENTION

The idea on which the present invention is based is that of producing a propeller propulsion system formed by an inboard electric motor and a surface piercing propeller, connected by means of a box-like body which can be applied to the transom of a watercraft. The box-like body is a housing, and the term "housing" and "box-like body" are used as synonyms in the following description.

Advantageously, to convert a watercraft having a combustion-based propulsion system, the combustion-based propulsion system is removed, leaving a hole in the transom, and the box-like body is applied so as to close the hole left by the previous propulsion system, with the electric motor inboard and the outdrive of the surface piercing propeller outside the watercraft.

Advantageously, the Applicant has noted that the coupling of the inboard electric motor and the surface piercing propeller, as well as the operation of the surface piercing propeller, ensure balancing of weights, thereby reducing battery consumption and improving speed performance.

Still according to the idea of the solution described above, the transmission means are grouped together in the box-like body and are implemented in the form of a system of two or more pulleys and a dry-operating drive belt. Such a configuration of the transmission means in the closed box-like body allows lubrication means to be avoided and therefore the risk of polluting the water to be eliminated.

On the basis of the idea of the solution described above, the technical problem is solved by a propeller propulsion system and by a method for applying the propulsion system according to the accompanying claims.

In Particular:

The propeller propulsion system for a watercraft of the present invention comprises at least one electric motor and a propeller which can be driven by the electric motor, and is characterized in that:

the propeller is a surface piercing propeller, the propeller propulsion system comprises a box-like body (housing) having a side wall to which the electric motor is fixed and a cover part through which an outdrive of the surface piercing propeller is applied, the side wall and the cover part comprising holes through which a shaft of the motor and a shaft of the outdrive respectively pass, the box-like body comprises means for transmission of motion from the drive shaft to the outdrive shaft, and the propulsion system is further provided with means for fixing the box-like body to a transom of the watercraft, this transom being provided with a hole for receiving the electric motor inboard and the fixing means hermetically sealing the box-like body on the transom. The box-like body closes the hole in the transom, leaving the electric motor inboard and the propeller outboard.

According to one aspect of the invention, the transmission means comprise a first pulley mounted on the drive shaft, a second pulley mounted on the outdrive shaft and a drive belt between the first and second pulleys, the belt being applied dry, the box-like body, the drive shaft and the outdrive being without lubricating means.

According to variation of embodiments of the present invention, the system comprises two or more motors. For example: a first motor and a second motor, the first motor and the second motor having drive shafts associated with respective pulleys in the box-like body, and the drive belt being mounted on the pulleys of the motors and on the pulley of the outdrive shaft, the drive shafts being aligned at a predetermined height of the box-like body and the outdrive shaft being centred beneath the drive shafts, at the centre of the box-like body.

The box-like body has a pentagonal shape with a base directed upwards and a vertex directed downwards, intended to be directed towards the water when the watercraft is being used, the base being parallel to the line along which said drive shafts are aligned and the vertex being aligned with an axis of rotation of the pulley of the outdrive shaft.

A transmission ratio between the electric motor and the surface piercing propeller is associated with a ratio between a number of cogs of the pulley of the drive shaft and a number of cogs of the pulley of the outdrive shaft.

According to one aspect of the invention, the system comprises an electric trimming device and an electric rudder device for varying, respectively, a vertical and horizontal inclination of the outdrive, the trimming device and the rudder device being applied to the box-like body, preferably via the cover part. Said variation is performed by controlling a universal joint of the outdrive by means of the trimming device and the rudder device. The universal joint does not have lubricants, in order to reduce further pollution of the water.

The side wall of the box-like body comprises holes for the passage of electrical cables joined, at one end, to the trimming device and the rudder device, and intended to be joined, at an opposite end, to the watercraft control means, preferably a joystick steering control.

Still according to the idea of the solution described above, the technical problem is solved by a method for applying a propeller system for a watercraft, comprising at least one electric motor and a propeller which can be driven by the electric motor. The method comprises the following steps:

- a hole is provided in the transom of the watercraft, for example through the removal of a diesel or petrol propulsion system previously installed on the watercraft,
- at least one electric motor is applied to a side wall of a box-like body, outside the box-like body, leaving a shaft of the motor to pass through the side wall, through a hole in the side wall, protruding into the box-like body;
- a pulley is applied to the drive shaft, inside the box-like body;
- the box-like body is fixed to the transom of the watercraft, hermetically closing the hole in the transom with the side wall of the box-like body, and leaving the electric motor inboard;
- an outdrive equipped with a surface piercing propeller is applied to a cover part of the box-like body, leaving a shaft of the outdrive to pass through the cover part, through a hole in the cover part; a pulley is applied to the outdrive shaft;
- a drive belt is applied on the pulley of the drive shaft and on the pulley of the outdrive shaft and the box-like body is closed with the cover part.

Advantageously, the propulsion system can be supplied preassembled, i.e. with the motor and the outdrive already applied to the box-like body. In that case, converting a watercraft having a combustion-based propulsion system is even quicker.

Further advantages and features of the propulsion system according to the present invention and of the method for applying it will emerge from the description given hereinbelow with reference to a number of drawings provided purely by way of a non-limiting example.

BRIEF DESCRIPTION OF THE DRAWINGS

FIG. 3: is a front cut-away view of the propulsion system of FIG. 1.

FIG. 4*a*: is a front view of only the box-like body (without cover part) of the propulsion system of FIG. 1, and FIG. 4*b* is a view according to the cross-section A-A of the box-like body (the hole through which the drive shaft passes is not shown).

DETAILED DESCRIPTION

With reference to the appended drawings, an example of embodiment of a propulsion system according to the invention is given hereinafter, indicated as a whole by the reference number 1. The example is given in order to clarify the object of the present invention, and the technical characteristics described herein do not limit the scope of protection of the invention.

The propulsion system 1 is a propeller system for a watercraft, for example for a pleasure boat used to navigate on a lake. Naturally, as will become clear from the description, there is nothing to prohibit the propulsion system 1 from being applied to a watercraft for maritime use and/or to a watercraft having larger dimensions than those of a pleasure boat. In any case, the purpose of the propeller system 1 of the present invention is that of reducing and substantially eliminating the water and air pollution from the watercraft, both by eliminating combusted materials, intended to be discharged into the air or water, and by eliminating oil or synthetic lubricants or grease for lubricating moving parts. A further object of the present invention is to make available a propulsion system 1 which can easily substitute and replace the known combustion-based propulsion means, mounted on watercraft which are already in operation.

Figure 1:
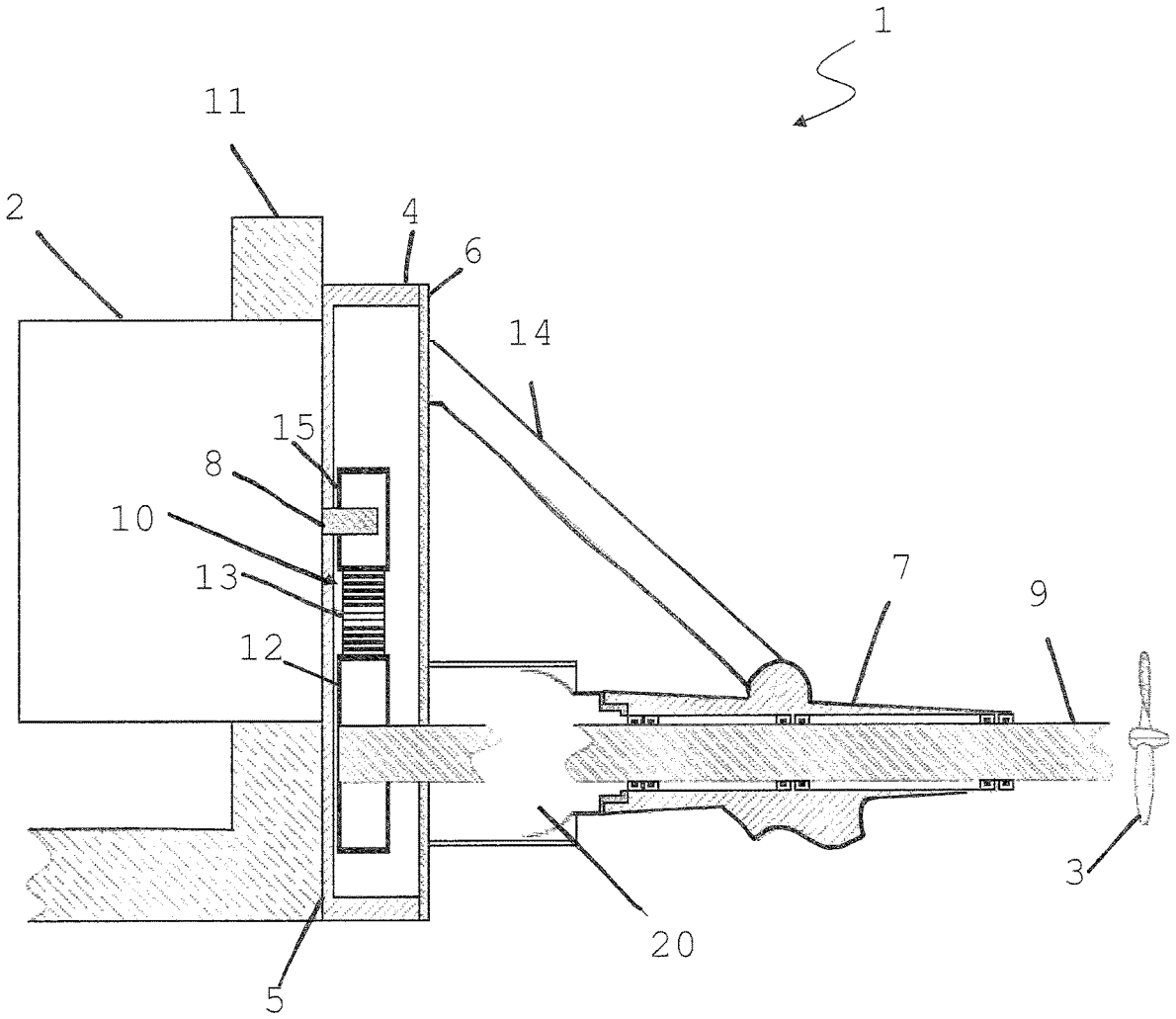
FIG. 1: is a side view of the propulsion system for a watercraft, according to the present invention.

To this end, as schematically represented in the cross-section of FIG. 1, which shows a portion of the stern, in cross-section, of a watercraft comprising the propulsion system 1 according to the present invention, an electric motor 2 is used, said motor being powered by rechargeable batteries, preferably by a battery pack (not shown in the drawing), and intended to be housed in the rear and/or side part(s) of the watercraft and to be electrically connected to the motor 2. The propulsion system 1 is equipped with a propeller 3 which can be driven by the electric motor 2 via the mechanical coupling of a shaft of the motor and a shaft of the propeller.

The propeller 3 is a surface piercing propeller intended to operate at the stern of the watercraft. The propeller 3 is made up of two or more blades which function as fluid-dynamic elements in order to impose a variation in the quantity of motion in the advancing direction of the watercraft and which are keyed onto a hub connected to a shaft of an outdrive 7 of the propulsion system. In particular, the surface piercing propeller 3 is a pusher propeller.

According to the present invention, the propulsion system 1 comprises a box-like body 4 (housing 4) having a side wall 5 to which the electric motor 2 is fixed and a cover part 6 on which an outdrive 7 of the surface piercing propeller 3 is applied.

Figure 2:
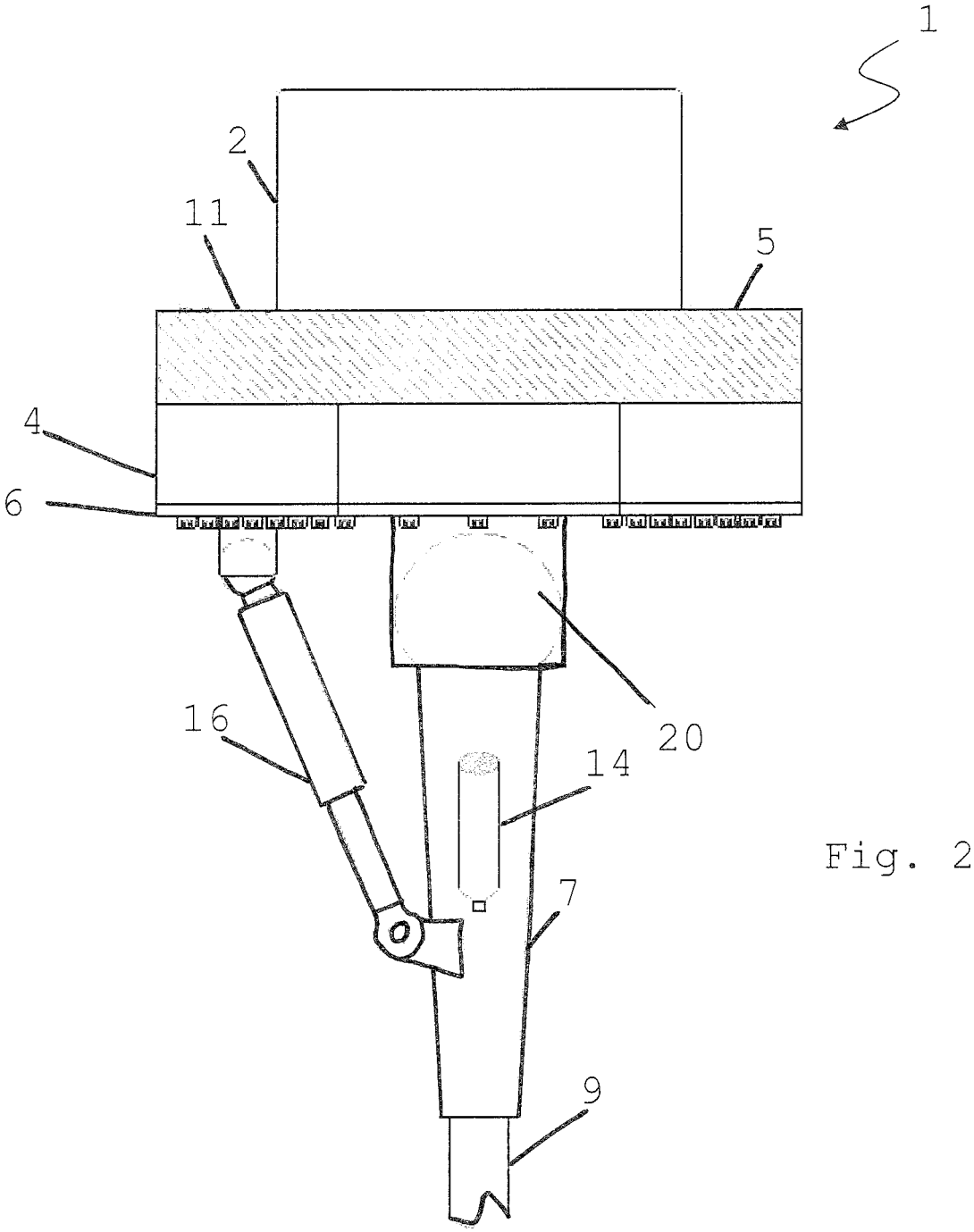
FIG. 2: is a view from above of the propulsion system of FIG. 1.
Figure 5A:
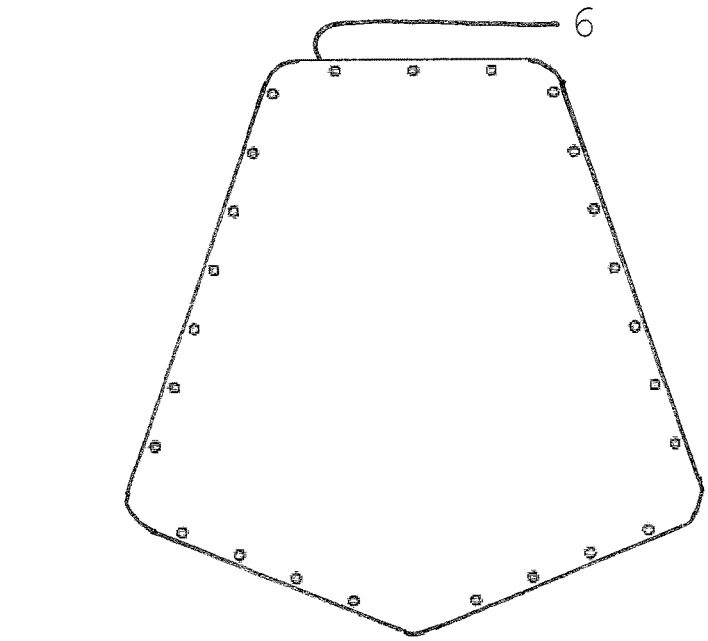
FIGS. 5*a* and 5*b*: are a front view and a side view, respectively, of the cover part of the box-like body of FIG. 4 (the hole through which the shaft of the propeller passes is not shown).
Figure 5B:
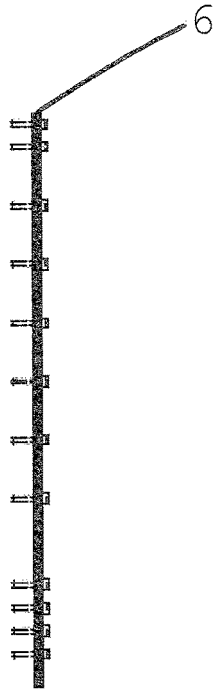
Figure 6:
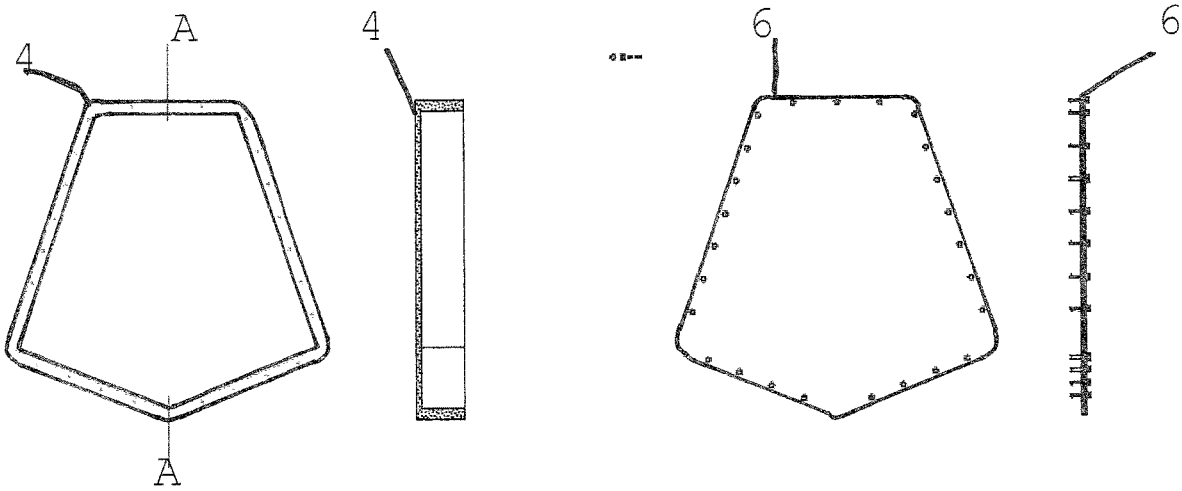
FIG. 6: shows, in front and side views, the assembly formed by the side wall and the cover part of FIGS. 4*a*, 4*b*, 5*a* and 5*b*.

As is clear from FIGS. 1 and 2, the side wall 5 and the cover part 6 comprise holes for receiving, respectively, a shaft 8 of the motor 2 and a shaft 9 of the outdrive 7, more precisely an end of said shaft 9 opposite the end on which the hub of the propeller 3 is applied. The shaft 8 of the motor 2 and said end of the shaft 9 of the outdrive 7 are coupled inside the box-like body 4, while the motor 2 and the outdrive 7 are applied externally to the box-like body 4 and, when the propulsion system is being used, inboard and outboard of the watercraft respectively. Inside the box-like body 4, transmission means 10 connect the drive shaft 8 to the end of the outdrive shaft 9.

The propulsion system 1 is further provided with means for fixing the box-like body 4 to a transom 11 of the watercraft.

In particular, the transom 11 comprises a hole for receiving inboard the electric motor 2 of the propulsion system 1. Once the motor has been inserted inboard, the means for fixing the propulsion system hermetically seal the transom 11, via the side wall 5 of the box-like body 4.

Advantageously, the box-like body according to the present invention performs various functions. First of all, it contains the transmission means 10 and allows the mechanical coupling of the electric motor 2 and the surface piercing propeller 3 to be achieved via the outdrive 7, independently of the watercraft. As a result of such a configuration advantageously it is possible to produce a propulsion system 1 in all its parts, separately from the watercraft. In particular, the propulsion system 1 forms a module which can be applied integrally to a watercraft, suitably provided with an opening on the transom 11 that is sufficiently large to receive the electric motor, without disassembling it from the box-like body 4. In this case, the motor is made to pass through the opening on the transom, which is hermetically sealed by the side wall 5 of the box-like body 4, preferably by suitable gaskets.

According to another aspect of the present invention, the propulsion system 1 is assembled on the spot, first positioning the motor 2 inboard, then passing the drive shaft 8 through a small opening in the transom 11, then applying the box-like body 4 so as to hermetically seal said small hole, with the drive shaft 8 which passes through into the hole in the side wall 5 of the box-like body 4, and lastly achieving the coupling between the drive shaft 8 and the outdrive shaft 9.

More specifically, the transmission means 10 in the box-like body 4 comprise a first pulley 15 mounted on the drive shaft 8, a second pulley 12 mounted on the outdrive shaft 9 and a drive belt 13 between the first and second pulleys.

According to a particularly advantageous aspect of the present invention, preferably, the belt 13 is of the dry-operating type and the box-like body 4, the drive shaft 8 and the outdrive 9 are substantially devoid of lubricating means. Thus, not only are atmospheric and water pollution prevented, since the electric motor 2 does not have gas emissions, but water pollution is further reduced, and substantially eliminated, due to the fact that there are no emissions of oil, synthetic materials or lubricants associated with the movement of the mechanical propulsion components.

According to a preferred embodiment, the Applicant has envisaged that the propulsion system 1 also is devoid of lubricants in the control parts of the outdrive 7 as well. To this end, the outdrive 7 comprises a universal joint 20, and the propulsion system 1 comprises a trimming device and a rudder device, preferably mounted on the box-like body 4 and mechanically connected to the universal joint 20 in order to vary a vertical or horizontal inclination of the outdrive 7, and consequently vary the speed or direction of the watercraft. Thus, according to said preferred embodiment, the universal joint 20 and the means for coupling the joint with the trimming device and the rudder device area also lubricant-free.

Figure 7:
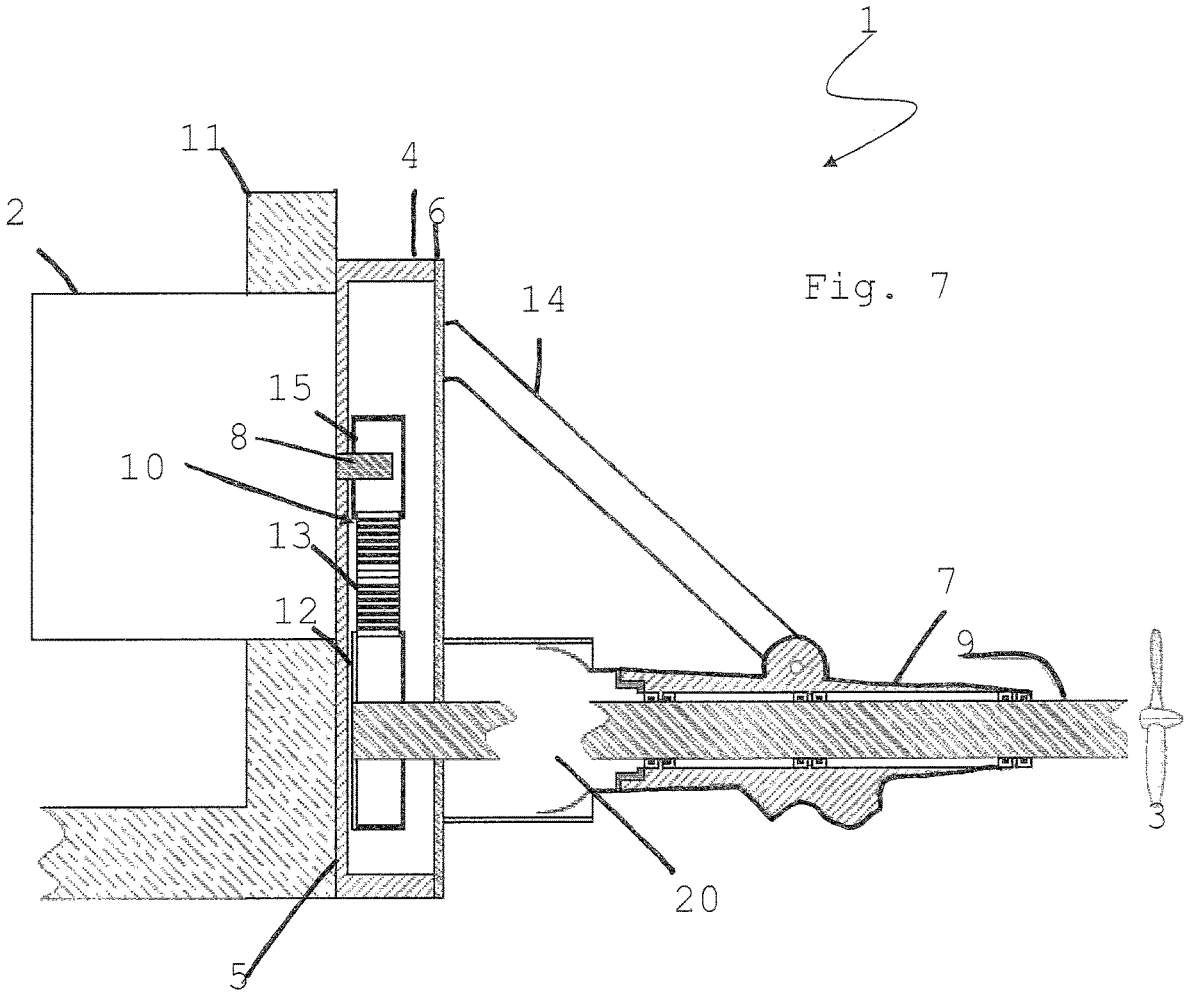
FIG. 7: is a side view of the propulsion system for a watercraft, according to a variation of embodiment of the present invention.
Figure 8:
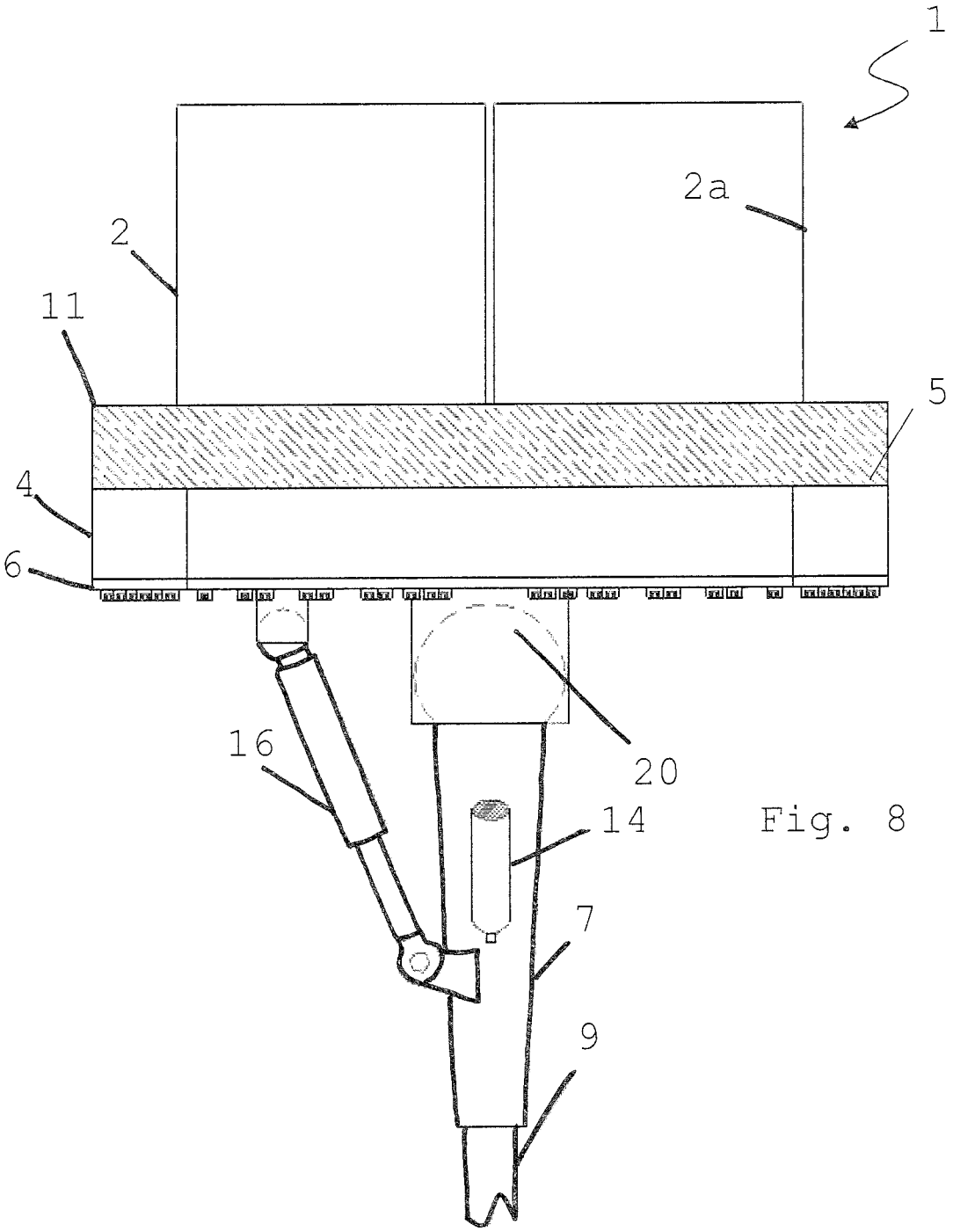
FIG. 8: is a view from above of the propulsion system of FIG. 7.
Figure 9:
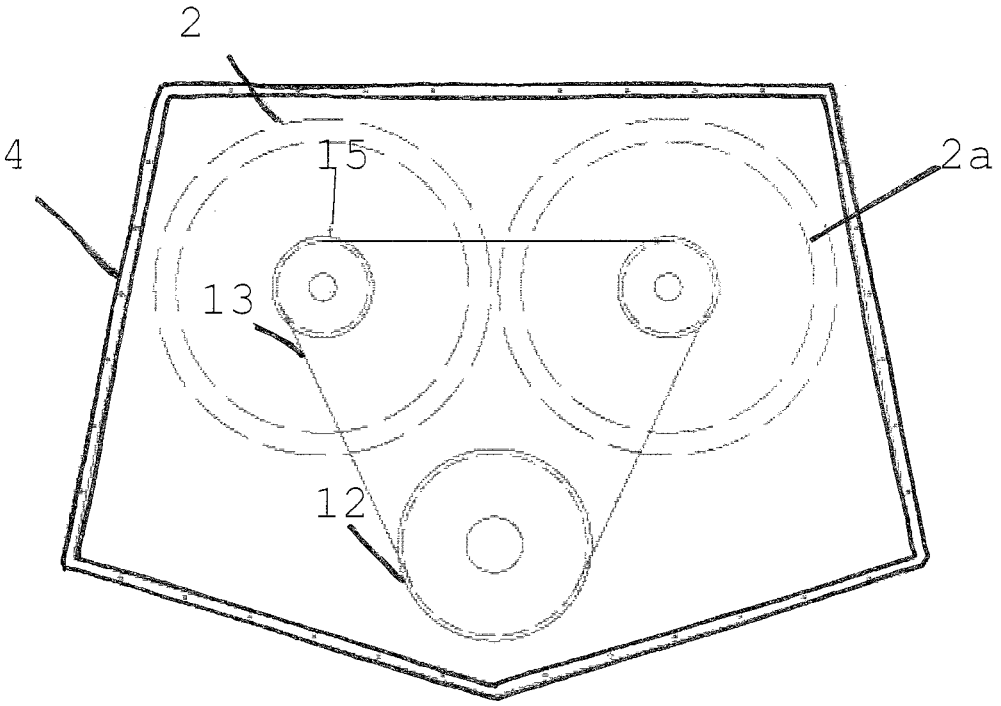
FIG. 9: is a front cut-away view of the propulsion system of FIG. 7.
Figure 10A:
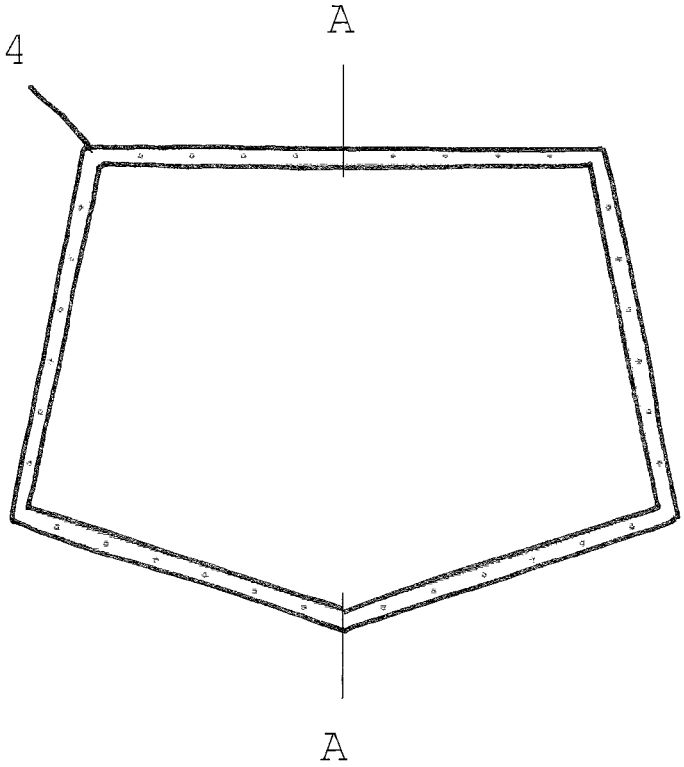
FIG. 10*a*: is a front view of only the box-like body (without cover part) of the propulsion system of FIG. 7.
Figure 10B:
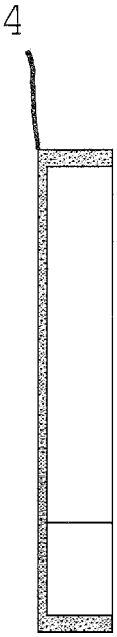
FIG. 10*b* is a view according to the cross-section A-A of the box-like body (the hole through which the drive shaft passes is not shown).
Figure 11A:
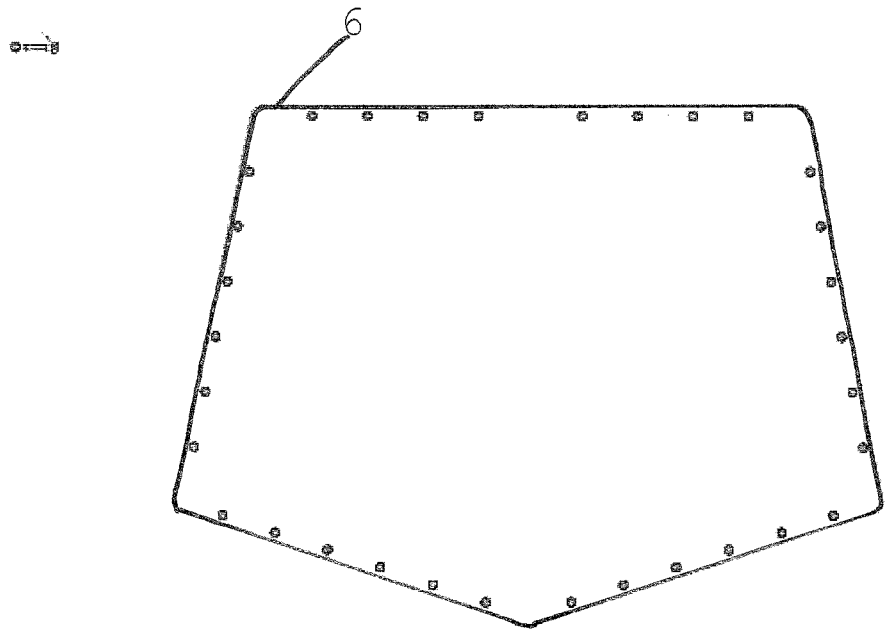
FIGS. 11*a* and 11*b*: are a front view and a side view, respectively, of the cover part of the box-like body of FIG. 10 (the hole through which the shaft of the propeller passes is not shown).
Figure 11B:
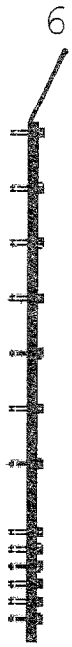
Figure 12:
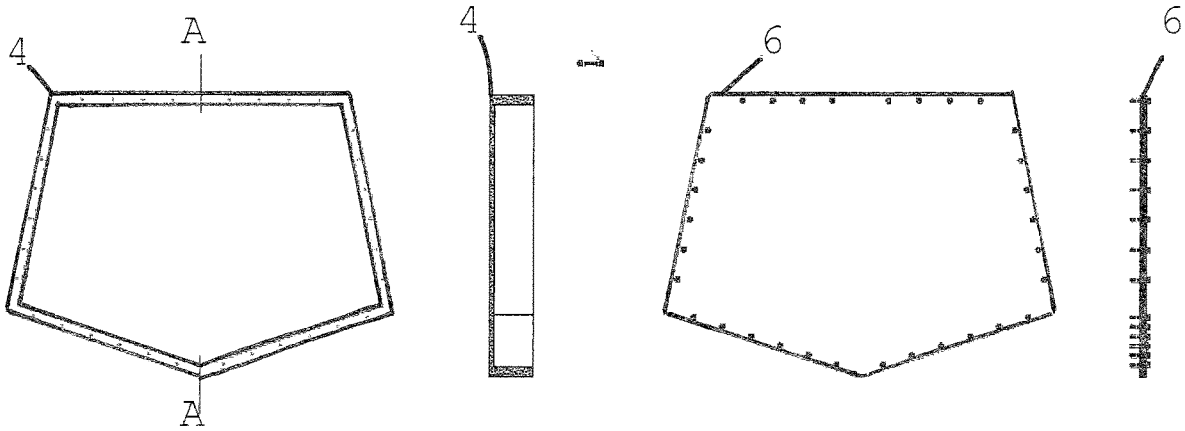
FIG. 12: shows, in front and side views, the assembly formed by the side wall and the cover part of FIGS. 10*a*, 10*b*, 11*a* and 11*b*.

Still remaining within the scope of protection of the present invention, the propulsion system can be equipped with several electric motors, for example two motors 2, 2*a* as in the example provided with reference to FIG. 7. A first motor 2 is equipped with a first shaft 8 and a second motor 2*a* is equipped with a second shaft 8*a*, and each shaft 8, 8*a* is associated with a respective pulley 15, 15*a* inside the box-like body 4, passing through holes on the side wall 5 of the box-like body 4. Both the motors are fixed to the side wall, since they are in fact intended to remain both inboard.

In this embodiment, the drive belt 13 is mounted dry on the pulleys 15, 15*a* of the shafts and on the pulley 12 of the outdrive shaft 9, and simultaneously transmit the movement of the drive shafts to the outdrive shaft 9.

Preferably, the drive shafts 8, 8*a* are aligned at a predetermined height of the box-like body 4 and the outdrive shaft 9 is centred beneath the drive shafts 8, 8*a*, preferably at the centre of the box-like body 4.

FIGS. 3 to 6 and 9 to 12 show, in various cross-sectional, front and partially cut-away views, the box-like body of the propulsion system 1.

According to these examples of embodiments, the box-like body 4 has a pentagonal shape with a base directed upwards and a vertex directed downwards, that is, intended to be directed towards the water when the watercraft is being used, i.e. with the base parallel to the line along which the drive shafts 8, 8*a* are aligned and the vertex aligned with an axis of rotation of the pulley 12 of the outdrive shaft 9.

Such a shape of the box-like body 4 is preferred since it reproduces the shape of the transom 11 and converges towards the keel. However, the scope of protection of the present invention includes box-like bodies with other shapes, for example those with rounded or curved side surfaces or cover part, or with a bottom side intended to follow the profile of a transom which is not flat.

Advantageously, according to the propulsion system of the present invention, a transmission ratio between the electric motor 2 or the electric motors 2, 2*a* and the surface piercing propeller 3 is associated with a ratio between a number of cogs of the pulley of the drive shaft 8 and a number of cogs of the pulley of the outdrive shaft 9. Various propulsion systems with various performance levels can therefore be produced by selecting the power of the electric motor, the size of the pulleys, the length of the outdrive, the propeller blades, etc., said selection being made depending on the dimensions and weight of the watercraft for which the propulsion system 1 is intended.

A particular application of the propulsion system according to the present invention may be performed in an unusually simple manner, and is described purely by way of a non-limiting example here below.

Initially, a hole is provided in the transom of the watercraft, for example through the removal of a diesel or petrol propulsion system previously installed on the watercraft. Said hole is for example sufficiently large to arrange inboard the electric motor of the propulsion system, by passing it through the hole. One end of the drive shaft passes through the hole while the motor remains completely inboard.

Then the electric motor 2 is applied to a side wall 5 of the box-like body 4, leaving a drive shaft 8 of the motor 2 to pass through a hole in the side wall 5, protruding into the box-like body 4; then a pulley 15 is applied to the drive shaft 8, inside the box-like body.

The box-like body 4 is fixed to the transom 11 of the watercraft, hermetically closing the hole in the transom with the side wall 5 of the box-like body 4, preferably by means of suitable gaskets, and leaving the electric motor 2 inboard.

After completing the operations indicated above, it is possible to apply an outdrive 7 equipped with a surface piercing propeller 3 to a cover part 6 of the box-like body 4, leaving a shaft 9 of the outdrive 7 to pass through the cover part 6, through a hole in the cover part 6; a pulley 12 is applied to the outdrive 9. At this point, a drive belt 13 is applied on the pulley 15 of the drive shaft 8 and on the pulley 12 of the outdrive shaft 9 and the box-like body 4 is closed with the cover part 6.

The invention claimed is:

1. A propeller propulsion system for a watercraft, comprising at least one electric motor and a surface piercing propeller which can be driven by the electric motor, a housing having a side wall, to which said at least one electric motor is fixed, and a cover part to which an outdrive of the surface piercing propeller is applied, the side wall and the cover part comprising holes through which a shaft of said at least one motor and a shaft of the outdrive respectively pass, the shaft of the motor and the shaft of the outdrive being coupled inside the housing, said housing comprising means for transmission of motion from the drive shaft to the outdrive shaft, and said propulsion system being further provided with means for fixing the housing to a transom of the watercraft, said transom being provided with a hole for receiving the electric motor inboard and said fixing means being adapted to hermetically seal the housing on the transom, closing the hole with the housing;

wherein said transmission means comprise a first pulley mounted on the drive shaft, a second pulley mounted on the outdrive shaft and a drive belt between the first and second pulleys, said belt being applied dry and said housing, said drive shaft and said outdrive being free from lubricating means, the system further comprising a first motor and at least one second motor, said first motor and said second motor having drive shafts associated with respective pulleys in the housing, and said drive belt being mounted on the pulleys of the motors and on the pulley of the outdrive shaft, the drive shafts being aligned at a predetermined height of the housing and said outdrive shaft being centered beneath the drive shafts, at a center of the housing.

2. The system according to claim 1, wherein said housing has a pentagonal shape with a base directed upwards and a vertex directed downwards, intended to be directed towards the water in use, the base being parallel to the line along which said drive shafts are aligned and the vertex being aligned with an axis of rotation of the pulley of the outdrive shaft.

3. The system according to claim 1, wherein a transmission ratio between the electric motor and the surface piercing propeller is associated with a ratio between a number of cogs of the pulley of the drive shaft and a number of cogs of the pulley of the outdrive shaft.

4. The system according to claim 1, wherein said outdrive comprises a dry universal joint and said propulsion system comprises an electric trimming device and an electric rudder device for controlling the universal joint in order to vary a vertical and horizontal inclination respectively of the outdrive, said trimming device and said rudder device being applied to the housing via the cover part.

5. The system according to claim 4, wherein the side wall of said housing comprises holes for the passage of electrical cables joined, at one end, to the trimming device and the rudder device, and intended to be joined, at an opposite end, to watercraft control means.

6. The system according to claim 1, wherein said cover part is closed onto the housing by means of several removable screws.

7. A method for applying a propeller propulsion system for a watercraft, comprising a propeller which can be driven by an electric motor, wherein:

a hole is provided in the transom of the watercraft through the removal of a diesel or petrol propulsion system previously installed on the watercraft, a first electric motor and a second electric motor are applied to a side wall of a housing, leaving driving shafts of the motors to pass through the side wall, through holes in the bottom side, protruding into the housing; pulleys are applied to the drive shafts, inside the housing;

the housing is fixed to the transom of the watercraft, hermetically closing the hole in the transom with the side wall of the housing, and leaving the electric motors inboard;

an outdrive equipped with a surface piercing propeller is applied to a cover part of the housing, leaving a shaft of the outdrive to pass through the cover part, through a hole in the cover part; a pulley is applied to the outdrive shaft;

a drive belt is applied on the pulleys of the drive shafts and on the pulley of the outdrive shaft and the housing is closed with the cover part, wherein the drive belt is applied dry, the housing, the drive shafts and the outdrive are free from lubricating means, the drive shafts are aligned at a predetermined height of the housing and the outdrive shaft is centered beneath the drive shafts at a center of the housing.

* * * * *